US005996735A

United States Patent [19]

Perritt et al.

[11] Patent Number: 5,996,735

[45] Date of Patent: Dec. 7, 1999

[54] DOCK STATION

[76] Inventors: Joyce Claress Perritt, 1701 Wallace Lake Rd.; Ruth Ann Johnson, 4241 Railroad St., both of Pace, Fla. 32571

[21] Appl. No.: 08/863,491

[22] Filed: May 27, 1997

[51] Int. Cl.[6] ..... E06C 7/16

[52] U.S. Cl. ..... 182/115; 182/129

[58] Field of Search ..... 182/20, 115, 77, 182/129, 132, 230, 164; 52/186

[56] References Cited

U.S. PATENT DOCUMENTS 4,751,982 6/1988 Wolfe ..... 182/164

5,082,087 1/1992 Hubbell ..... 182/77 X

*Primary Examiner*—Daniel P. Stodola
*Assistant Examiner*—Hugh B. Thompson
*Attorney, Agent, or Firm*—Peter Loffler

[57] ABSTRACT

A docking station is comprised of a body member having one or more steps leading to a platform. A protective wall is positioned on one side of the steps and around the platform, save for a single opening. A guide rail is positioned on the device on the same side as the opening. The guide rail receives a shopping cart such that the seating portion of the shopping cart is aligned with the opening. A safety rail extends from the guide rail to the platform protective wall opposite the stairs protective wall.

6 Claims, 3 Drawing Sheets

DOCK STATION

BACKGROUND OF THE INVENTION

1. Field of the Invention

The present invention relates to a docking station for shopping carts so that small children may safely and easily ascend the station and position themselves within the seat portion of the shopping cart.

2. Background of the Prior Art

Placing a child into the seating portion at the back of a standard shopping cart can be a difficult task. The child, especially a relatively large and heavier child, can prove too much for a person of modest strength to lift up and place into seat. Even when strength is not a problem, a person's hands may be preoccupied with a baby, thus not allowing that person to lift the other child. The result is a seating attempt that is fraught with danger.

The person may attempt to lift that child even though the child is beyond the person's strength capacity. The person may cause injury to himself or the child in the awkward lift. Alternately, the person may encourage the child to climb up the front of the shopping cart, into the shopping cart and finally into the seat portion of the cart. As the cart was not designed for a child to scale the front of the cart, such a maneuver can result in toppling of the cart and injury to the child. Another favorite for seating a child within the cart is to place the cart near an object such as a bench or stacked cartons of groceries and have the child climb onto the object and into the seat. In such a maneuver, the cart can roll away from the child as he attempts to seat himself in the cart or the object onto which he climbed can collapse, again resulting in injury.

In order to provide a safer means for a child's ascension into the seating portion of shopping cart, a shopping cart docking station has been proposed by Hubbell in his U.S. Pat. No. 5,082,087. This device provides a docking station that corrals the shopping cart within the device and permits a child's use of the device only during shopping cart presence. A remote release lever must be activated in order to release the shopping cart from the device's hold. Although achieving the desired goal, the device, by having several moving components, is very complex in design, in manufacture, and in maintenance. Such a drawback increases the costs associated with the device. The device has a large footprint which curtails its presence in many shopping establishments where available interior real estate is at a premium. As the device is large and requires device activation from the user, many people will be discouraged from using the device due to lack of understanding of device operation.

Therefore, there is a need in the art for a device that permits quick and safe child ascension and access to the seating portion of a shopping cart. The device must overcome the drawbacks of the prior art in that the device must be relatively simple in design, manufacture, and maintenance. The device must be relatively simple and straightforward to use and will, ideally, have no moving parts or other manipulations required of the user. The device should occupy a relatively small amount of real estate.

SUMMARY OF THE INVENTION

The docking station of the present invention addresses the aforementioned needs in the art. The device is a simple straightforward solution to safely loading a child into the seating portion of a shopping cart.

The docking station is comprised of a body member having one or more stairs ascending to a platform. A protective wall extends upwardly on one side of the stairs and leads to a protective wall surrounding the platform on three sides. An opening is found on one side of the platform protective wall. A guide rail, having a relatively wide open end and a closed end is attached to the body member on the same side as the opening. A safety rail extends from the guide rail to the platform protective wall opposite the stairs protective wall.

The guide rail receives one and possibly two of the wheels on one side of a shopping cart such that when properly received within the device, the seating portion of the shopping cart is aligned with the opening permitting a child who has ascended the stairs to pass through the opening and seat himself within the seating portion. One or two lips or detents can be appropriately positioned on the guide to help prevent the shopping cart from rocking within or from rolling away from the device during loading maneuvers.

The docking station of the present invention is of simple and straightforward design and construction and is easy to maintain. Having no moving parts, the device can be constructed in a lightweight material such as plastic or the like and can be constructed in one or at most a very few number of pieces appropriately attached to one another. The simplicity of the device makes the device attractive to use even for people who may have a technophobia. The protective walls, rail and steadying features of the device make the device safe to use. Using the minimal amount of space to properly achieve its task, the device has a relatively small footprint making its placement into crowded establishments easier.

BRIEF DESCRIPTION OF THE DRAWINGS

Similar reference numerals refer to similar parts throughout the several views of the drawings.

DESCRIPTION OF THE PREFERRED EMBODIMENT

Figure 1:
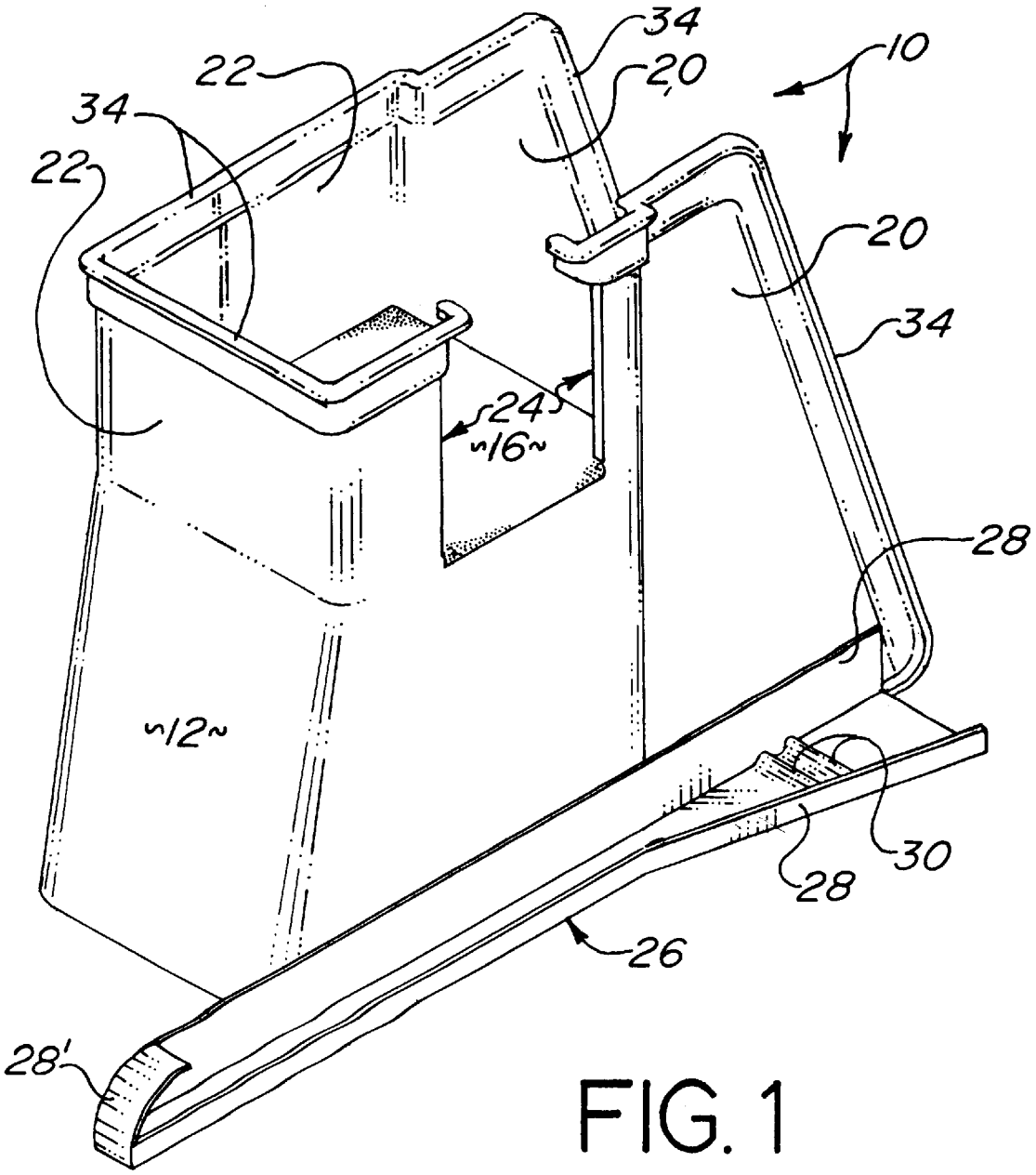
FIG. 1 is a perspective view of the docking station of the present invention.
Figure 2:
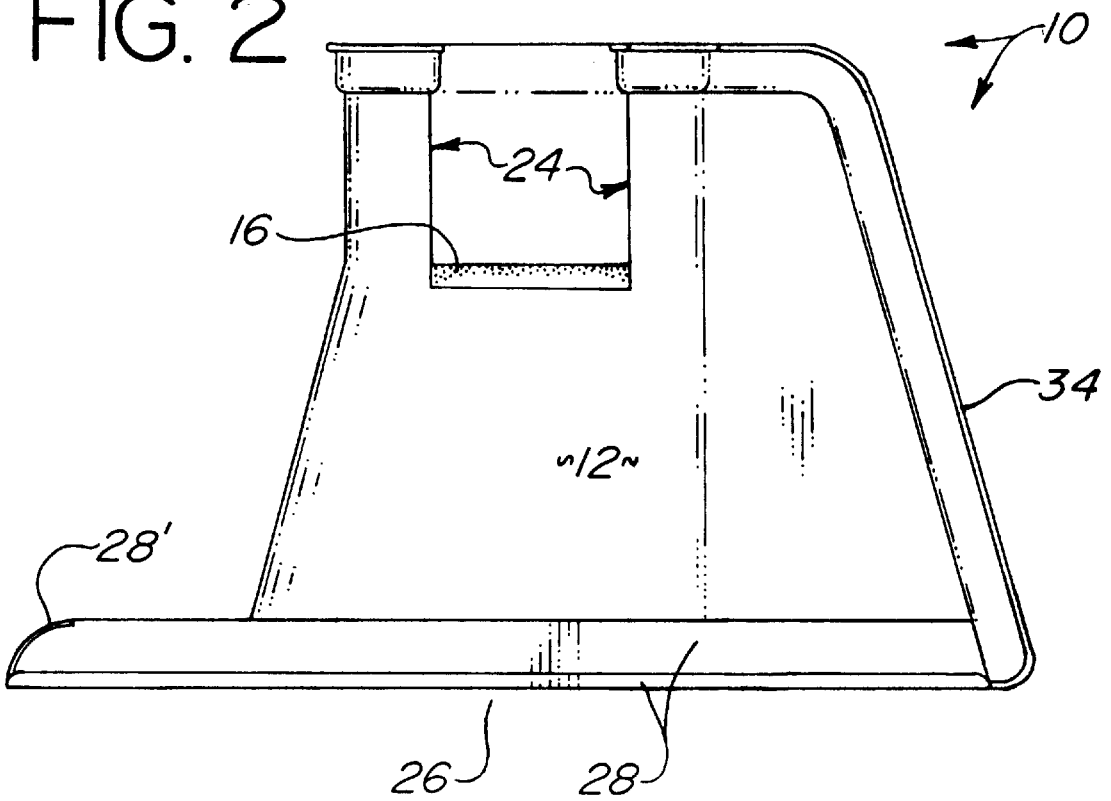
FIG. 2 is a side elevation view of the docking station.
Figure 3:
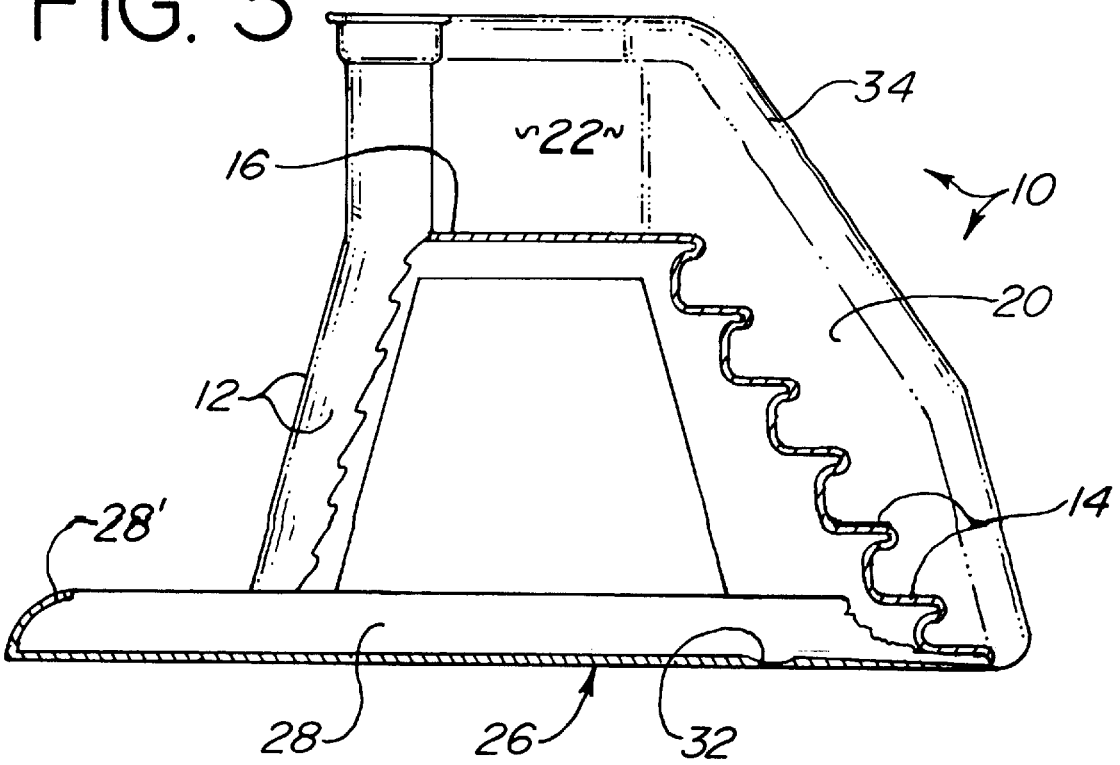
FIG. 3 is a cutaway view of FIG. 2.
Figure 4:
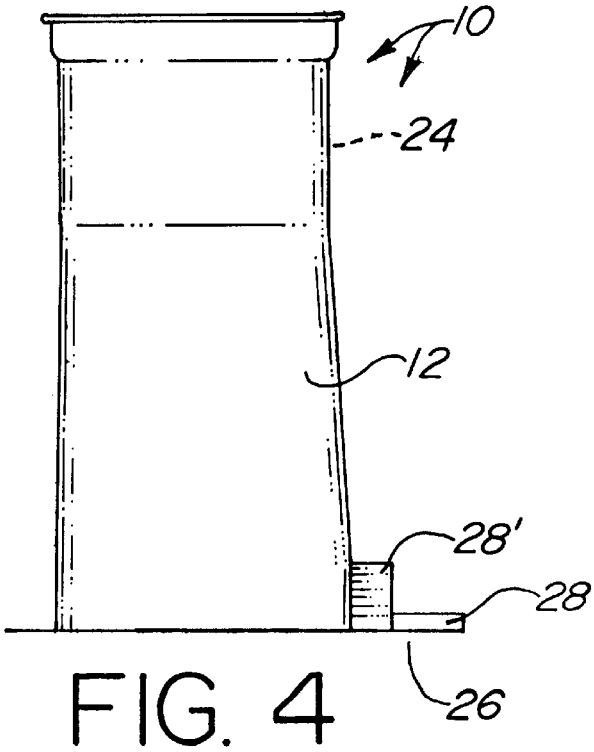
FIG. 4 is a rear elevation view of the docking station.
Figure 5:
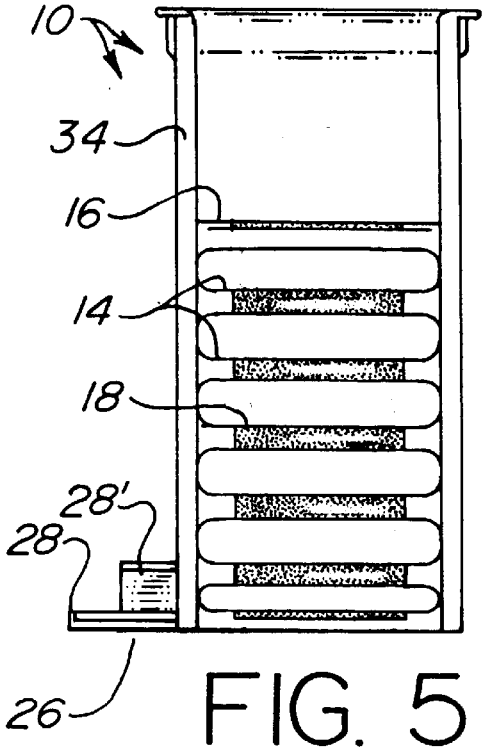
FIG. 5 is a front elevation view of the docking station.
Figure 6:
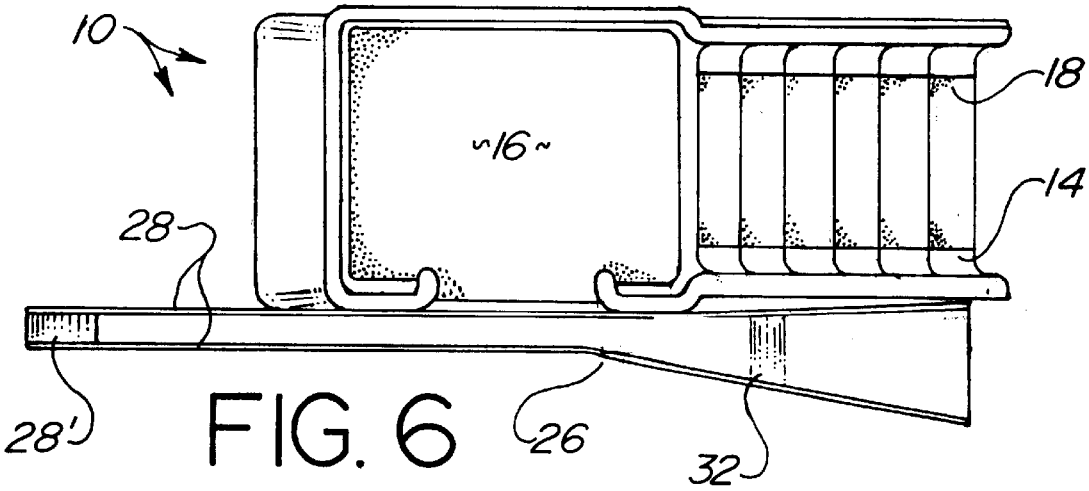
FIG. 6 is a top plan view of the docking station.

Referring now to the drawings, it is seen that the docking station of the present invention, generally denoted by reference numeral 10, is comprised of a body member 12, having one or more steps 14 leading to a platform 16. Each step 14 and the platform 16 may have appropriate non-slip properties such as a non-slip layer 18 secured to the step 14 or appropriate non-slip design molded directly into each step 14. A protective stair wall 20 extends upwardly the length of the steps 14 on one side and leads to a protective platform wall 22 surrounding the outer periphery of the platform 16. The protective stair wall 20 and the protective platform wall 22 can be enclosed as shown, or can be of appropriate rail and bar construction. An opening 24 is found on one side of the protective platform wall 22. A guide rail 26 is attached to the body member 12 on the same side as the opening 24. As seen, the guide rail 26 may extend beyond either end of the body member 12. One end of the guide rail 26 is open while the opposing end is closed. The closed end 28' of the guide rail may be curled. The open end of the guide rail 26 may be relatively wider and will gradually taper until the guide rail 26 maintains a generally constant width. A pair of flange 28 extend upwardly from either side of the guide rail. The guide rail 26 may have one or two lips 30, as shown in FIG. 1, or one or two detents 32, as shown in FIG. 3, each spaced close together, proximate the open end of the guide rail. A safety rail 34 can extend diagonally upwardly from the guide rail 26 to the platform safety wall 22.

In order to utilize the docking station 10 of the present invention, a standard shopping cart is maneuvering into the device 10 such that one of the cart's front wheels enter the guide rail 26. The wide open end of the guide rail 26 assures easy threading of the cart into the guide rail 26. The cart is further maneuvered until the seating portion at the rear of the cart is aligned with the opening 24. A child ascends the steps 14 until reaching the platform 16 and then passes through the opening 24 and seats himself within the cart. The protective stair wall 20 and the safety rail 34 protect the child from falling off of the device 10 during step 14 ascension, while the protective platform wall 22 protect the child from falling off of the platform 16 upon reaching the platform 16.

The guide rail 26 is dimensioned and positioned such that the seating portion of the shopping cart aligns with the opening for standard shopping carts. The use of one lip 30 or detent 32 will catch the back wheel of the shopping cart and prevent the cart from rolling out of the device 10 prematurely. The lip 30 or detent 32 are of such dimension that a user will be able to breach them with very modest effort. The use of two closely spaced apart lips 30 or detents 32 will catch the back wheel of the shopping cart therebetween and prevent rocking of the shopping cart during child seating. The closed end of the guide rail 26 will also assist in holding the shopping cart steady during loading maneuvers.

It is expressly recognized that the lips 30 or detents 32 can be positioned proximate the closed end of the guide rail 26 in order to capture the front wheels of the shopping cart. It is also expressly recognized that the guide rail 26 may be dimensioned and positioned such that a shopping cart may be backed into the device 10 through the open end of the guide rail.

While the invention has been particularly shown and described with reference to an embodiment thereof, it will be appreciated by those skilled in the art that various changes in form and detail may be made without departing from the spirit and scope of the invention.

We claim:

1. A cart docking station for securing a cart, the cart having a first pair of wheels on one side and a second pair of wheels on an opposing side, each of the first pair of wheels and the second pair of wheels having a front wheel and a back wheel, and permitting a child to embark onto the cart the cart docking station comprising:

a body member, having a first side and a second side, adapted to rest on a floor;

a platform proximate the top of the body member;

at least one step leading to the platform; and a guide rail member having an open end, a first flange extending along the guide rail member and attached to the outer surface of the first side of the body member, a second flange extending along the guide rail member in spaced apart relation to the first guide rail member, a closed end extending between the first flange and the second flange and curling toward the open end, a first lip extending between the first flange and the second flange, and a second lip extending between the first flange and the second flange and oriented generally parallel to the first lip.

2. The cart docking station as in claim 1 wherein the open end of the guide rail is wider relative to the closed end of the guide rail.

3. The cart docking station as in claim 1 wherein each of the at least one steps has a non-slip surface.

4. The cart docking station as in claim 1 wherein the platform has a non-slip surface.

5. The cart docking station as in claim 1 further comprising a safety rail extending from the guide rail to the platform wall.

6. The cart docking station as in claim 5 further comprising a safety rail extending from the detention means to the platform wall.

* * * * *